US010836161B2

(12) United States Patent
Watanabe

(10) Patent No.: US 10,836,161 B2
(45) Date of Patent: Nov. 17, 2020

(54) LIQUID EJECTING HEAD AND LIQUID EJECTING APPARATUS

(71) Applicant: Seiko Epson Corporation, Tokyo (JP)

(72) Inventor: Shunsuke Watanabe, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/443,984

(22) Filed: Jun. 18, 2019

(65) Prior Publication Data

US 2019/0381794 A1 Dec. 19, 2019

(30) Foreign Application Priority Data

Jun. 19, 2018 (JP) ..... 2018-116136
Jan. 30, 2019 (JP) ..... 2019-014211

(51) Int. Cl.
*B41J 2/14* (2006.01)
*B41J 2/045* (2006.01)
*B41J 2/175* (2006.01)

(52) U.S. Cl.
CPC ..... *B41J 2/14* (2013.01); *B41J 2/045* (2013.01); *B41J 2/14233* (2013.01); *B41J 2/17593* (2013.01)

(58) Field of Classification Search
None
See application file for complete search history.

(56) References Cited

U.S. PATENT DOCUMENTS

2015/0267868 A1* 9/2015 Yoshida ..... B41J 2/14233 137/798
2016/0347055 A1* 12/2016 Yamaguchi ..... B41J 2/14072
2018/0029395 A1* 2/2018 Sugiura ..... B41J 2/14201

FOREIGN PATENT DOCUMENTS

JP 2016-000488 A 1/2016

* cited by examiner

*Primary Examiner* — Shelby L Fidler
(74) *Attorney, Agent, or Firm* — Harness, Dickey & Pierce, P.L.C.

(57) ABSTRACT

A liquid ejecting head including a head unit including a liquid ejecting unit that ejects a liquid from a nozzle, a drive circuit that drives the liquid ejecting unit, a containing body in which a space that stores the liquid is formed; a fixing plate which contacts the head unit on a nozzle side of the head unit; and a support that contacts the fixing plate and that supports the head unit, in which the support is formed of a material having a thermal conductivity higher than that of the containing body.

19 Claims, 6 Drawing Sheets

LIQUID EJECTING HEAD AND LIQUID EJECTING APPARATUS

The entire disclosures of Japanese Patent Application No. 2018-116136, filed Jun. 19, 2018 and 2019-014211, filed Jan. 30, 2019 are expressly incorporated by reference herein.

BACKGROUND

1. Technical Field

The present disclosure relates to a technique for ejecting a liquid such as ink.

2. Related Art

For example, JP-A-2016-000488 discloses a liquid ejecting head that ejects a liquid such as ink from a plurality of nozzles. A drive IC that drives piezoelectric elements that eject ink from the nozzles is mounted in the liquid ejection head.

In a technique of JP-A-2016-000488, the drive IC generates heat by driving of the piezoelectric elements and the temperature inside a liquid ejection head increases, and, accordingly, viscosity of the ink is changed. Accordingly, there is a problem that an error in ink ejection characteristics occurs.

SUMMARY

In order to overcome the above issue, a liquid ejecting head according to a suitable aspect of the present disclosure includes a head unit including a liquid ejecting unit that ejects a liquid from a nozzle, a drive circuit that drives the liquid ejecting unit, a containing body in which a space that stores the liquid is formed; a fixing plate which contacts the head unit on a nozzle side of the head unit; and a support that contacts the fixing plate and that supports the head unit, in which the support is formed of a material having a thermal conductivity higher than that of the containing body.

DESCRIPTION OF EXEMPLARY EMBODIMENTS

First Embodiment

Figure 1:
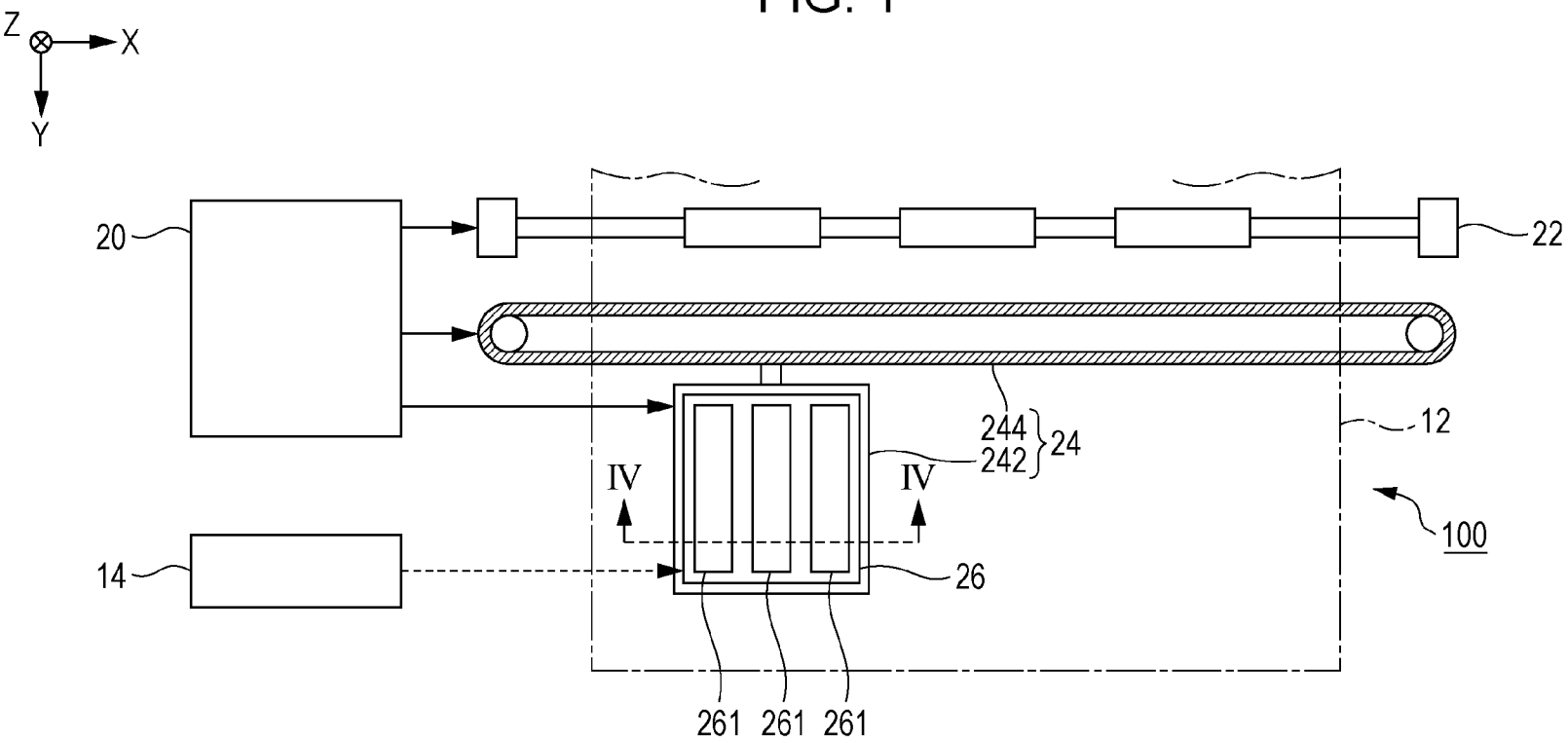
FIG. 1 is a block diagram illustrating a configuration of a liquid ejecting apparatus according to a first embodiment of the present disclosure.

FIG. 1 is a block diagram illustrating an example of a liquid ejecting apparatus 100 according to a first embodiment of the present disclosure. The liquid ejecting apparatus 100 of the first embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is installed in the liquid ejecting apparatus 100. For example, a cartridge configured to detach from the liquid ejecting apparatus 100, a bag-shaped ink pack formed of a flexible film, or an ink tank into which ink can be refilled is used as the liquid container 14. A plurality of types of inks of different colors are stored in the liquid container 14.

As illustrated as an example in FIG. 1, the liquid ejecting apparatus 100 includes a control unit 20, a transport mechanism 22, a moving mechanism 24, and a liquid ejecting head 26. The control unit 20 includes a processing circuit such as a central processing unit (CPU) or a field programmable gate array (FPGA) and a memory circuit such as a semiconductor memory, and controls each element of the liquid ejecting apparatus 100 in an integrated manner. The transport mechanism 22 transports the medium 12 in a Y direction under the control of the control unit 20.

The moving mechanism 24 reciprocates head units 261 in an X direction under the control of the control unit 20. The X direction is a direction intersecting (typically, orthogonal) to the Y direction in which the medium 12 is transported. The moving mechanism 24 of the first embodiment includes a substantially box-shaped transport body 242 (a carriage) that houses the head units 261 and a transport belt 244 to which the transport body 242 is fixed. Note that a configuration in which a plurality of head units 261 are mounted in the transport body 242 or a configuration in which the liquid container 14 is mounted in the transport body 242 together with the head units 261 can be adopted.

The liquid ejecting head 26 includes the plurality of head units 261. Each head unit 261 ejects ink, which has been supplied from the liquid container 14, to the medium 12 through a plurality of nozzles (in other words, ejection holes) under the control of the control unit 20. Concurrently with the transportation of the medium 12 performed with the transport mechanism 22 and the repetitive reciprocation of the transport body 242, the head units 261 eject ink onto the medium 12 to form a desired image on a surface of the medium 12. Note that a direction perpendicular to an XY plane is hereinafter referred to as a Z direction. The ink ejection direction of each head unit 261 corresponds to the Z direction. The XY plane is, for example, a plane parallel to the surface of the medium 12. The Z direction is typically the vertical direction.

Figure 2:
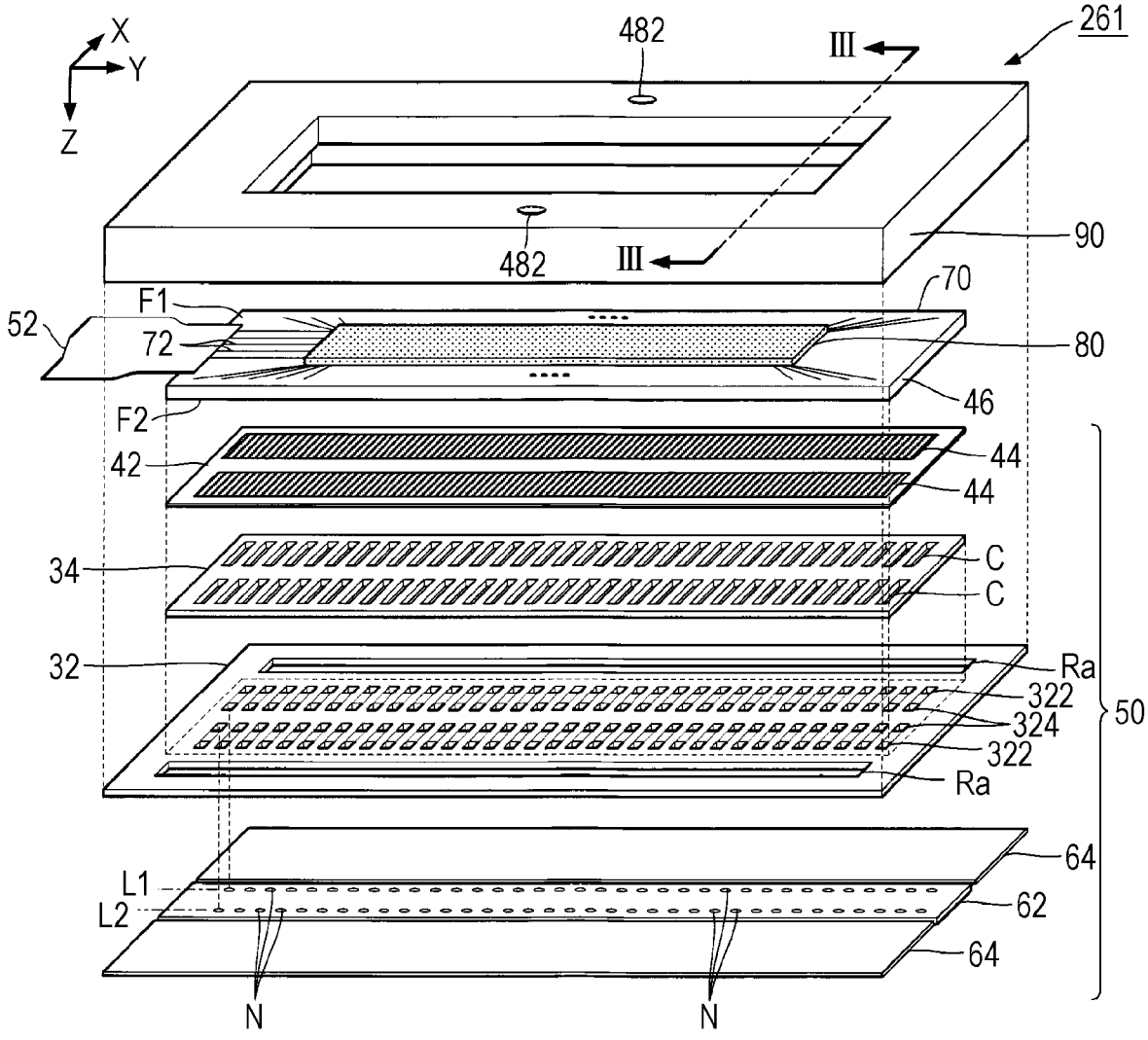
FIG. 2 is an exploded perspective view of a head unit.
Figure 3:
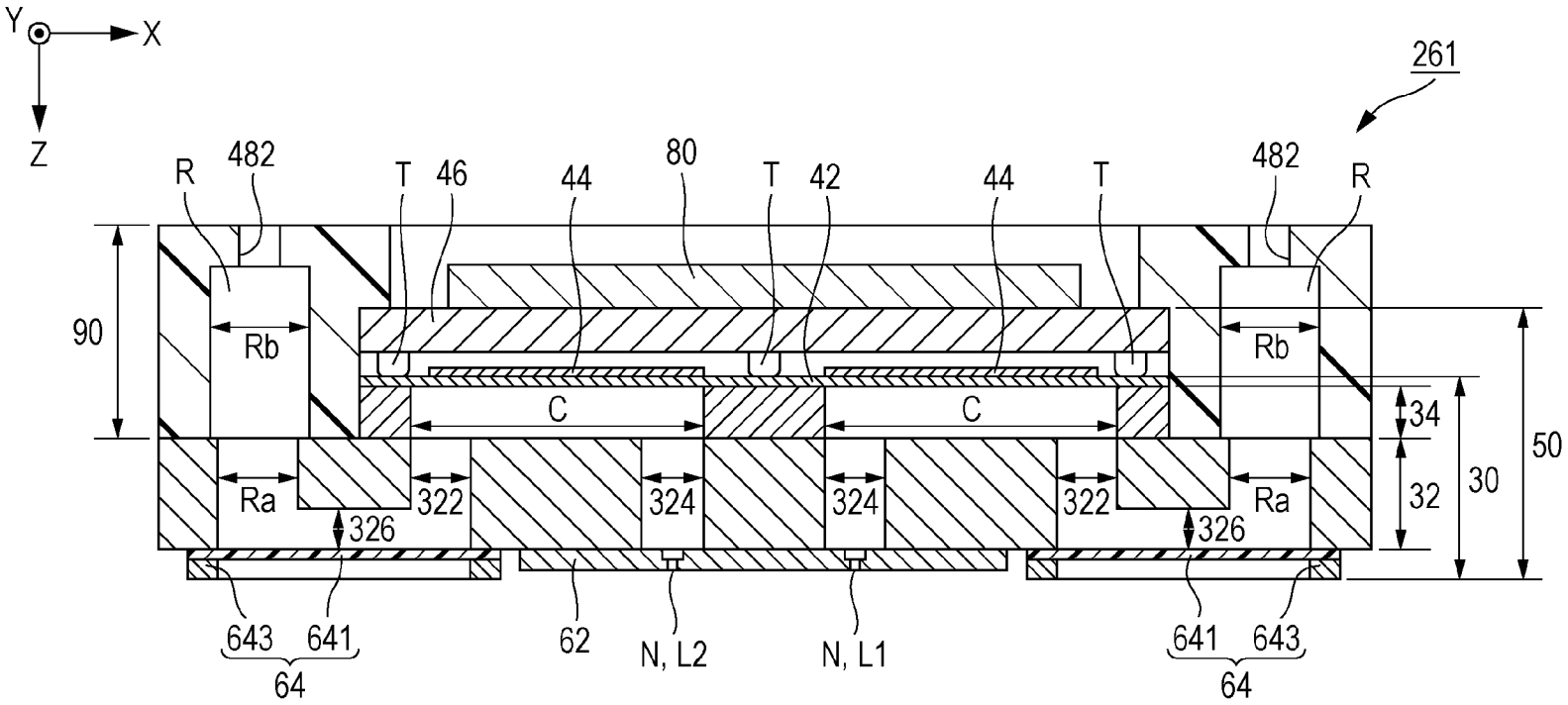
FIG. 3 is a cross-sectional view of the head unit (a cross-sectional view taken along line III-III in FIG. 2).

FIG. 2 is an exploded perspective view of the head unit 261, and FIG. 3 is a cross-sectional view taken along line III-III in FIG. 2. As illustrated as an example in FIG. 2, the head unit 261 includes a plurality of nozzles N arranged in the Y direction. The plurality of nozzles N of the first embodiment are divided into a first line L1 and a second line L2 that are arranged side by side with a space in between in the X direction. Each of the first line L1 and the second line L2 is a set of a plurality of nozzles N linearly arranged in the Y direction. Note that while the positions of the nozzles N of the first line L1 and those of the second line L2 in the Y direction can be different from each other (in other words, arranged in a zigzag manner or arranged in a staggered manner), for the sake of convenience, a configuration in which the positions of the nozzles N of the first line L1 and those of the second line L2 in the Y direction are set to coincide each other is described below as an example. As it can be understood from FIG. 3, the head unit 261 of the first embodiment is structured so that the elements related to each of the nozzles N in the first line L1 and the elements related to each of the nozzles N in the second line L2 are disposed in a substantially axisymmetric manner.

As illustrated as an example in FIGS. 2 and 3, the head unit 261 includes a liquid ejecting unit 50 that ejects ink from the nozzles N, a drive circuit 80 that drives the liquid ejecting unit 50, and a containing body 90 in which a space that stores ink is formed.

The liquid ejecting unit 50 includes a flow path structure 30 in which pressure chambers C that communicate with the nozzles N are formed, piezoelectric elements 44 that change pressures of the pressure chambers C, and a wiring substrate 46 on and in which wiring that electrically connects the drive circuit 80 and the piezoelectric elements 44 to each other is formed. The piezoelectric elements 44 are each an example of a driving element.

The flow path structure 30 is a structure that forms flow paths that supply ink to the plurality of nozzles N. The flow path structure 30 of the first embodiment includes a flow path substrate 32, a pressure chamber substrate 34, a diaphragm 42, a nozzle plate 62, and vibration absorbers 64. Each member constituting the flow path structure 30 is a plate-shaped member elongated in the Y direction. The containing body 90 and the pressure chamber substrate 34 are mounted on a surface of the flow path substrate 32 on the negative side in the Z direction. On the other hand, the nozzle plate 62 and the vibration absorbers 64 are mounted on a surface of the flow path substrate 32 on the positive side in the Z direction. Each member is fixed with an adhesive agent, for example.

The nozzle plate 62 is a plate-shaped member having the plurality of nozzles N formed therein. Each of the plurality of nozzles N is a circular through hole through which ink passes. In the nozzle plate 62 of the first embodiment, the plurality of nozzles N constituting the first line L1 and the plurality of nozzles N constituting the second line L2 are formed. The nozzle plate 62 is fabricated by processing a single crystal substrate formed of silicon (Si) using a semiconductor manufacturing technique (for example, a processing technique such as dry etching or wet etching), for example. However, any known materials and any manufacturing methods can be adopted to manufacture the nozzle plate 62.

As illustrated in FIGS. 2 and 3, in the flow path substrate 32, a space Ra, a plurality of supply flow paths 322, a plurality of the communication flow paths 324, and a supply liquid chamber 326 are formed in each of the first line L1 and the second line L2. Each space Ra is an elongated opening formed in the Y direction in a plan view (that is, when viewed in the Z direction), and the supply flow paths 322 and the communication flow paths 324 are through holes formed in each nozzle N. Each supply liquid chamber 326 is an elongated space formed in the Y direction across a plurality of nozzles N, and communicates the space Ra and the plurality of supply flow paths 322 to each other. Each of the plurality of communication flow paths 324 overlaps a corresponding single nozzle N in plan view.

As illustrated in FIGS. 2 and 3, the pressure chamber substrate 34 is a plate-shaped member in which a plurality of pressure chambers C are formed in each of the first line L1 and the second line L2. The plurality of pressure chambers C are arranged in the Y direction. Each of the pressure chambers C (cavities) is an elongated space that is formed in each nozzle N and that extends in the X direction in a plan view. Similar to the nozzle plate 62 described above, for example, the flow path substrate 32 and the pressure chamber substrate 34 are fabricated by processing a single crystal substrate formed of silicon using a semiconductor manufacturing technique. However, any known materials and any manufacturing methods can be adopted to manufacture the flow path substrate 32 and the pressure chamber substrate 34.

As illustrated in FIG. 3, the diaphragm 42 is formed on a surface of the pressure chamber substrate 34 opposite the flow path substrate 32. The diaphragm 42 of the first embodiment is a plate-shaped member configured to vibrate elastically. Note that portions or the entire diaphragm 42 can be formed so as to be integrated with the pressure chamber substrate 34 by selectively removing the plate-shaped member having a predetermined plate thickness at portions corresponding to the pressure chambers C in the plate thickness direction.

As can be understood from FIG. 3, the pressure chambers C are spaces located between the flow path substrate 32 and the diaphragm 42. A plurality of pressure chambers C are arranged in the Y direction in each of the first line L1 and the second line L2. As illustrated in FIGS. 2 and 3, the pressure chambers C are in communication with the communication flow paths 324 and the supply flow paths 322. Accordingly, the pressure chambers C are in communication with the nozzles N through the communication flow paths 324 and are in communication with the spaces Ra through the supply flow paths 322 and the supply liquid chambers 326.

As illustrated in FIGS. 2 and 3, the piezoelectric elements 44 are positioned on a surface of the flow path structure 30 on a side opposite the nozzles N. Specifically, in each of the first line L1 and the second line L2, the plurality of piezoelectric elements 44 each corresponding to different nozzles N are formed on the surface, in the diaphragm 42 of the flow path structure 30, on a side opposite the pressure chambers C. Each piezoelectric element 44 is a passive element that changes the pressure in the corresponding pressure chamber C by being deformed by a drive signal supplied from the drive circuit 80. The drive signal output from the drive circuit 80 is supplied to each piezoelectric element 44 through connection terminals T of the wiring substrate 46. The drive signal is a signal for driving the piezoelectric element 44.

The wiring substrate 46 in FIG. 2 is a plate-shaped member facing the surface of the diaphragm 42, on which the plurality of piezoelectric elements 44 are formed, with a gap in between. In other words, the wiring substrate 46 is positioned on the side opposite the flow path structure 30 with respect to the piezoelectric elements 44. Wiring that electrically connects the drive circuit 80 and the piezoelectric elements 44 to each other is formed in the wiring substrate 46. The wiring substrate 46 of the first embodiment also functions as a reinforcing plate that reinforces the mechanical strength of the head unit 261 and a sealing plate that protects and seals the piezoelectric elements 44. The wiring substrate 46 is electrically coupled to the control unit 20 through external wiring member 52. The external wiring member 52 is a flexible wiring substrate that supplies a drive signal from the control unit 20 to the wiring substrate 46. A connecting component such as a flexible printed circuit (FPC) or a flexible flat cable (FFC) is preferably employed as the external wiring member 52, for example.

The containing body 90 is a case for storing the ink supplied to the plurality of pressure chambers C. A surface of the containing body 90 on the positive side in the Z direction is bonded to the flow path substrate 32 with, for example, an adhesive agent. As illustrated as an example in FIG. 3, spaces Rb that store ink are formed in the containing body 90. Each space Rb is a space that is long in the Y direction. In the first embodiment, the spaces Rb are formed in each of the first line L1 and the second line L2. The spaces Rb of the containing body 90 and the space Ra of the flow path substrate 32 communicate with each other. The spaces configured by the space Ra and the space Rb function as liquid storage chambers (reservoirs) R that store the ink supplied to the plurality of pressure chambers C. The ink is supplied to the liquid storage chambers R through the inlet ports 482 formed in the containing body 90. The ink in the liquid storage chambers R is supplied to the pressure chambers C through the supply liquid chambers 326 and each supply flow path 322. The containing body 90 is formed, for example, by injection molding a resin material.

The vibration absorbers 64 are elements that absorb pressure fluctuations of the ink in the liquid storage chambers R. The vibration absorbers 64 of the first embodiment each includes an elastic film 641 and a support plate 643. The elastic film 641 is a flexible member formed in a film shape. The elastic film 641 of the first embodiment is installed on a surface of the flow path substrate 32 so as to close the space Ra, the connection flow path 326 and the supply flow path 322, and constitutes the bottom of the common liquid chamber R. The support plate 643 is a flat plate formed of a material with high rigidity such as stainless steel, and supports the elastic film 641 on the surface of the flow path substrate 32 so that the opening formed in the flow path substrate 32 is closed by the elastic film 641. The pressure fluctuation in the liquid storage chamber R is suppressed by deforming the elastic film 641 according to the pressure of the ink in the storage chamber R.

The wiring substrate 46 includes a base portion 70 and a plurality of lengths of wire 72. The base portion 70 is an insulating plate-shaped member elongated in the Y direction, and is positioned between the flow path structure 30 and the drive circuit 80. The base portion 70 is fabricated by processing a single crystal substrate formed of silicon using a semiconductor manufacturing technique, for example. However, any known materials and any manufacturing methods can be adopted to manufacture the base portion 70. The lengths of wire 72 transmits, for example, a drive signal. The plurality of lengths of wire 72 are positioned at an end portion of a first surface F1 of the base portion 70 on the negative side in the Y direction.

As illustrated as an example in FIG. 2, the base portion 70 includes the first surface F1 and a second surface F2 positioned opposite each other, and is fixed to a surface of the pressure chamber substrate 34 or the diaphragm 42 on a side opposite the flow path substrate 32 using an adhesive agent, for example. Specifically, the base portion 70 is installed so that the second surface F2 opposes the surface of the diaphragm 42 with an interval in between.

As illustrated as an example in FIG. 2, the drive circuit 80 and the external wiring member 52 are mounted on the first surface F1 of the base portion 70. In other words, the drive circuit 80 and the external wiring member 52 are mounted on the surface of the wiring substrate 46 on a side opposite the flow path structure 30. The drive circuit 80 is an IC chip elongated in a longitudinal direction (the Y direction) of the base portion 70. The external wiring member 52 is mounted on an end portion of the first surface F1 of the base portion 70 on the negative side in the Y direction. A plurality of lengths of wire that transmit a drive signal to the wiring substrate 46 are formed in the external wiring member 52, for example. The plurality of lengths of wire 72 of the wiring substrate 46 and the plurality of lengths of wire of the external wiring member 52 are electrically coupled to each other. With a driving operation of the piezoelectric elements 44, the drive circuit 80 generates heat.

Figure 4:
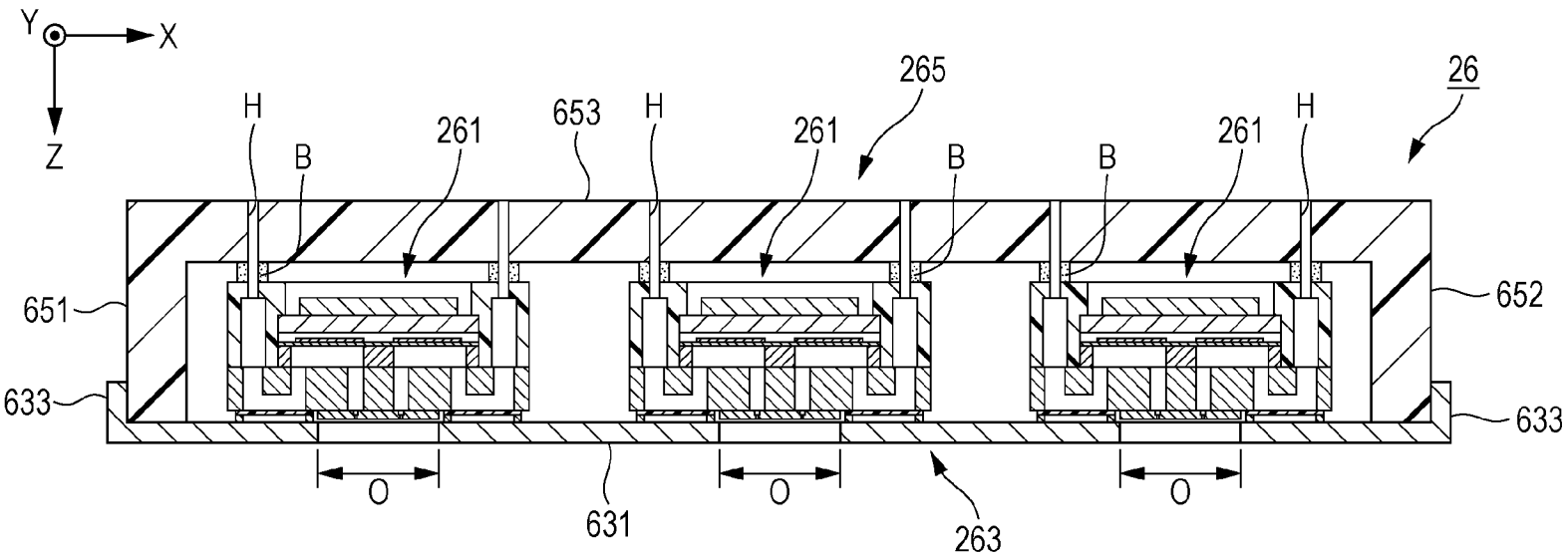
FIG. 4 is a cross-sectional view of a liquid ejecting head (a cross-sectional view taken along line IV-IV in FIG. 1).

FIG. 4 is a cross-sectional view taken along line IV-IV in FIG. 1 (a cross-sectional view of the liquid ejecting head 26). As illustrated as an example in FIG. 4, in addition to the plurality of head units 261, the liquid ejecting head 26 includes a fixing plate 263 to which the head units 261 are fixed and a support 265 that supports the head units 261 and the fixing plate 263.

The fixing plate 263 is a member formed of, for example, a highly rigid metal, and each head unit 261 is fixed to the fixing plate 263. For example, the fixing plate 263 is formed of stainless steel. As illustrated in FIG. 4, the fixing plate 263 of the first embodiment includes a fixing portion 631 and peripheral portions 633. The fixing portion 631 is a tabular portion extending in the X direction in cross sectional view. Meanwhile, the peripheral portions 633 are portions extending from a surface of the fixing portion 631 toward the negative side in the Z direction, and are formed in the outer periphery of the fixing portion 631 at portions extending in the Y direction.

As illustrated in FIG. 4, the plurality of head units 261 are fixed to a surface of the fixing portion 631 on the support 265 side. The plurality of head units 261 are fixed to the fixing portion 631 with a space in between each other. Portions of the head units 261 on the nozzle side (in other words, the positive side in the Z direction) contact the fixing portion 631. In other words, the flow path structure 30 of each head unit 261 contacts the fixing portion 631. Specifically, surfaces of the support plates 643 of the vibration absorbers 64 on the side opposite the elastic film 641 contact the fixing portion 631. As illustrated in FIG. 4, opening portions O are formed in the fixing portion 631 so as to correspond to the outer shapes of the nozzle plates 62. Accordingly, the nozzles N are exposed from the openings O.

The support 265 is a box-shaped structure including a flat portion 653 and a frame-shaped sidewall portion protruding from the periphery of the flat portion 653 towards the positive side in the Z direction. As illustrated in FIG. 4, the sidewall portion includes a first sidewall portion 651 and a second sidewall portion 652 that oppose each other. The first sidewall portion 651 and the second sidewall portion 652 are tabular portions extending in the Z direction. The first sidewall portion 651 and the second sidewall portion 652 are formed to correspond to portions on the positive side and the negative side in the X direction of the outer periphery of the fixing portion 631 extending in the Y direction. The plurality of head units 261 are positioned between the first sidewall portion 651 and the second sidewall portion 652. A portion of each sidewall portion on the positive side in the Z direction is joined to the corresponding peripheral portions 633 and the fixing portion 631 of the fixing plate 263. As illustrated in FIG. 4, an end portion of each sidewall portion on the positive side in the Z direction contacts a surface of the fixing portion 631, and a surface of each sidewall portion on the side opposite the head unit 261 contacts the corresponding peripheral portions 633. In other words, the fixing plate 263 and the sidewall portions are joined so that the peripheral portions 633 engage with the sidewall portions. As it can be understood from the above description, the support 265 contacts the fixing plate 263 at the outer periphery of the fixing plate 263.

As illustrated as an example in FIG. 4, the flat portion 653 opposes the fixing plate 263 with the head units 261 interposed therebetween. The head units 261 are joined to the surface of the flat portion 653 on the fixing plate 263 side. For example, a portion of the containing body 90 of each head unit 261 opposing the flat portion 653 is joined to the flat portion 653 with an adhesive agent B. Through holes H that supply the ink from the liquid container to the inlets 482 are formed in the flat portion 653 and the adhesive agents B.

The support 265 is formed of a material having a thermal conductivity higher than that of the containing body 90 and the fixing plate 263 of each head unit 261. For example, the support 265 is formed of a metal such as aluminum or copper. In the first embodiment, the entire support 265 is formed of metal. By forming the support 265 with a material having a thermal conductivity higher than that of the containing body 90 and the fixing plate 263, the heat generated inside the head units 261 is released to the support 265 through the fixing plate 263 in contact with the head units 261. Specifically, the heat generated in the drive circuit 80 of each head unit 261 is transmitted to the fixing plate 263 in contact with the support plate 643 of the corresponding vibration absorber 64 through the containing body 90 and the flow path structure 30 positioned in the vicinity of the drive circuit 80. The heat transmitted to the fixing plate 263 is radiated to the outside air through the support 265 in contact with the fixing plate 263. Accordingly, an increase in temperature inside each head unit 261 can be suppressed.

For example, in a configuration (hereinafter referred to as a "comparative example") in which the support 265 is formed of a material having a thermal conductivity lower than those of the containing body 90 and the fixing plate 263, the heat generated by the drive circuit 80 is not easily transmitted to the outside of the head unit 261 and a problem occurs in that the temperature inside the head unit 261 rises. On the other hand, compared with the comparative example, in the configuration of the first embodiment in which the support 265 is formed of a material having a thermal conductivity higher than those of the containing body 90 of each head unit 261 and the fixing plate 263, the heat generated in the drive circuit 80 is efficiently released from the fixing plate 263 through the support 265. Specifically, since the area that can be used to release heat is larger than that of the comparative example, the increase in temperature inside each head unit 261 can be suppressed. Accordingly, an error in ink ejection characteristics caused by an increase in the temperature inside the head unit 261 can be reduced.

The configuration of the first embodiment in which the support 265 is formed of metal has an advantage in the heat releasing efficiency of the heat generated in each drive circuit 80. Furthermore, in the first embodiment, since the support 265 contacts the fixing plate 263 at the outer periphery of the fixing plate 263, the heat of the drive circuit 80 can be released through the outer periphery of the fixing plate 263.

Second Embodiment

A second embodiment of the present disclosure will be described. Note that in the following examples, elements having functions similar to those of the first embodiment will be denoted by applying the reference numerals used in the description of the first embodiment, and detailed description of the elements will be omitted appropriately.

Figure 5:
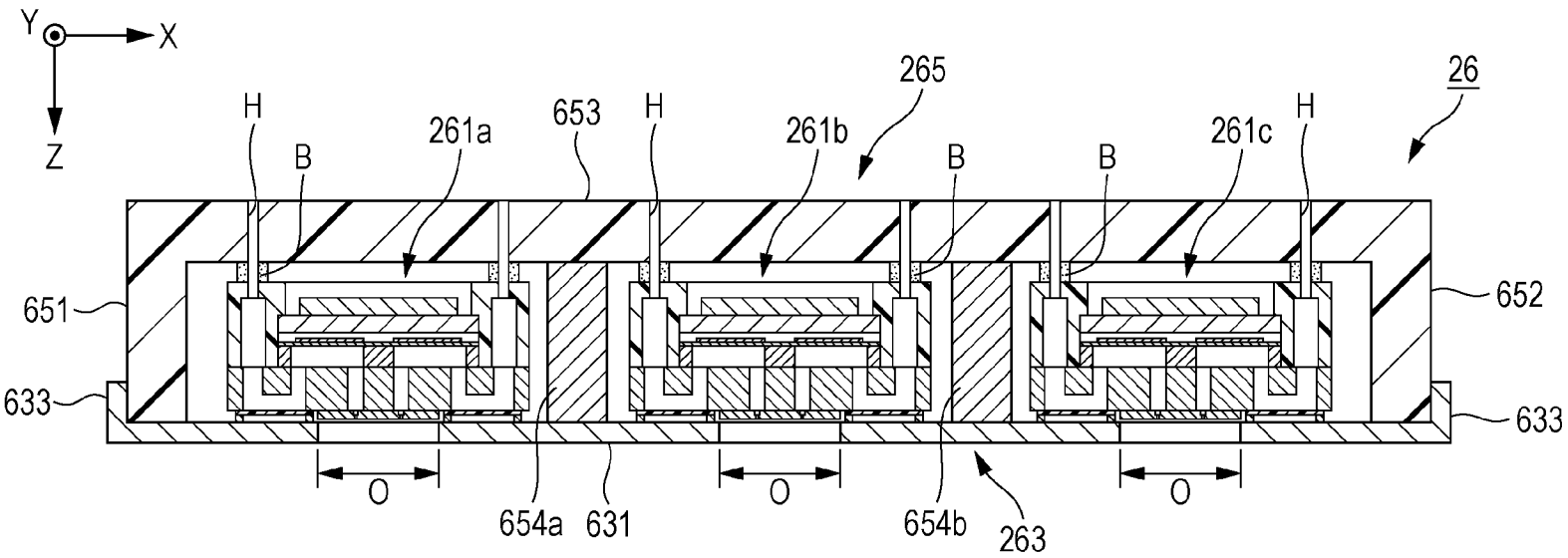
FIG. 5 is a cross-sectional view of a liquid ejecting head according to a second embodiment.

FIG. 5 is a cross-sectional view of the liquid ejecting head 26 according to the second embodiment. A configuration of the support 265 of the liquid ejecting head 26 of the second embodiment is different from that of the first embodiment. The head units 261 and the fixing plate 263 have the same configurations as those of the first embodiment.

As illustrated as an example in FIG. 5, the support 265 of the second embodiment includes contact portions 654 in addition to the first sidewall portion 651, the second sidewall portion 652, and the flat portion 653. The contact portions 654 are portions that contact the fixing plate 263 at a portion between the first sidewall portion 651 and the second sidewall portion 652. The contact portions 654 are each a tabular portion extending from the flat portion 653 towards the fixing plate 263.

A configuration in which a first head unit 261*a*, a second head unit 261*b*, and a third head unit 261*c* are fixed to the fixing plate 263 is assumed. A contact portion 654*a* contacts the fixing plate 263 at a portion between the first head unit 261*a* and the second head unit 261*b*. Similarly, a contact portion 654*b* contacts the fixing plate 263 at a portion between the second head unit 261*b* and the third head unit 261*c*. End portions of the contact portions 654 (654*a* and 654*b*) in the Z direction are joined to the surface of the fixing plate 263 with, for example, an adhesive agent. One of the first head unit 261*a* and the second head unit 261*b* is an example of a first head unit, and the other is an example of a second head unit. Furthermore, one of the second head unit 261*b* and the third head unit 261*c* is an example of the first head unit, and the other is an example of the second head unit.

In the second embodiment, the support 265 includes the first sidewall portion 651 and the second sidewall portion 652 contacting the outer periphery of the fixing plate 263, and the contact portions 654 contacting the fixing plate 263 at portions between the first sidewall portion 651 and the second sidewall portion 652; accordingly, in addition to the outer periphery of the fixing plate 263, the heat of the drive circuit 80 can be released from between the first sidewall portion 651 and the second sidewall portion 652. Heat is particularly likely to be accumulated between the head units 261 (261*a*, 261*b*, and 261*c*). In the second embodiment, since the support 265 includes the contact portions 654 in contact with the fixing plate 263 at portions between the head units 261, there is an advantage in that the heat accumulated between the head units 261 can be efficiently released.

Modifications

Each of the configurations described above illustrated as examples can be modified in various ways. Specific modification modes that can be applied to the embodiments described above will be exemplified below. Two or more modes optionally selected from the following examples may be combined appropriately as long as they do not contradict each other.

(1) The configurations of the support 265 are not limited to the example configurations described above. The shape of the support 265 may be any shape that includes a portion in which the support 265 is in contact with the fixing plate 263. For example, a configuration in which the support 265 includes elements other than the sidewall portion and the contact portions 654 or a configuration in which the support 265 does not include the flat portion 653 may be adopted. Portions of the fixing plate 263 in contact with the support 265 may be appropriately changed according to the configuration of the support 265. In other words, the portions of the fixing plate 263 in contact with the support 265 are not limited to the outer periphery of the fixing plate 263 or the portion between the first sidewall portion 651 and the second sidewall portion 652.

(2) In the configurations described above, the fixing plate 263 is constituted by the fixing portion 631 and the peripheral portions 633; however, the shape of the fixing plate 263 is not limited to the example described above. For example, the peripheral portions 633 may be omitted. However, the area in which the fixing plate 263 and the support 265 contact each other is large in the configuration in which the fixing plate 263 includes the peripheral portions 633 and the fixing portion 631, compared with the configuration in which the fixing plate 263 does not include the peripheral portions 633. Accordingly, the heat generated from each drive circuit 80 can be efficiently released from the support 265 through the fixing plate 263. Furthermore, the fixing plate 263 may include an element other than the fixing portion 631 and the peripheral portions 633.

(3) In the configurations described above, the support 265 is formed of a material having a thermal conductivity higher than those of the containing body 90 and the fixing plate 263; however, the support 265 does not necessarily have to be formed of a material having a thermal conductivity higher than that of the fixing plate 263. When the support 265 is formed of a material having a thermal conductivity higher than that of the containing body 90, the above-described effect in which the heat generated in each drive circuit 80 is released from the fixing plate 263 through the support 265 can be achieved. However, with the configuration in which the support 265 is formed of a material having a thermal conductivity higher than that of the fixing plate 263, the heat transmitted from each drive circuit 80 to the fixing plate 263 is easily transmitted to the support 265. Accordingly, compared with a configuration in which the support 265 has a thermal conductivity lower than that of the fixing plate 263, there is an advantage that the heat of each drive circuit 80 can be released efficiently.

(4) In the configurations described above, the entire support 265 is formed of a metal material having a thermal conductivity higher than that of the containing body 90; however, a portion of the support 265 may be formed of a material having a thermal conductivity higher than that of the containing body 90. For example, the sidewall portion in contact with the fixing plate 263 may be formed of a material having a thermal conductivity higher than that of the containing body 90, and the other portions may be formed of a material having a thermal conductivity lower than that of the containing body 90. Note that in the second embodiment, the contact portions 654 may be formed of a material having a thermal conductivity higher than that of the containing body 90.

(5) In the configurations described above, in each vibration absorber 64, the support plate 643 is in contact with the fixing plate 263; however, the portion in the flow path structure 30 in contact with the fixing plate 263 is not limited to the support 265. For example, when the support plate 643 is omitted in the vibration absorber 64, the elastic film 641 contacts the fixing plate 263. Furthermore, when the vibration absorbers 64 are omitted in the flow path structure 30, the flow path substrate 32 contacts the fixing plate 263. As described above, according to the configuration of the flow path structure 30, the portion of the flow path structure 30 in contact with the fixing plate 263 is appropriately changed. Furthermore, the configuration of the flow path structure 30 is not limited to the example configurations described above.

(6) In the configurations described above, the support 265 is formed of metal; however, the material of the support 265 may be any material that has a thermal conductivity higher than that of the containing body 90. For example, the support 265 may be formed of a highly heat-conductive resin.

Figure 6:
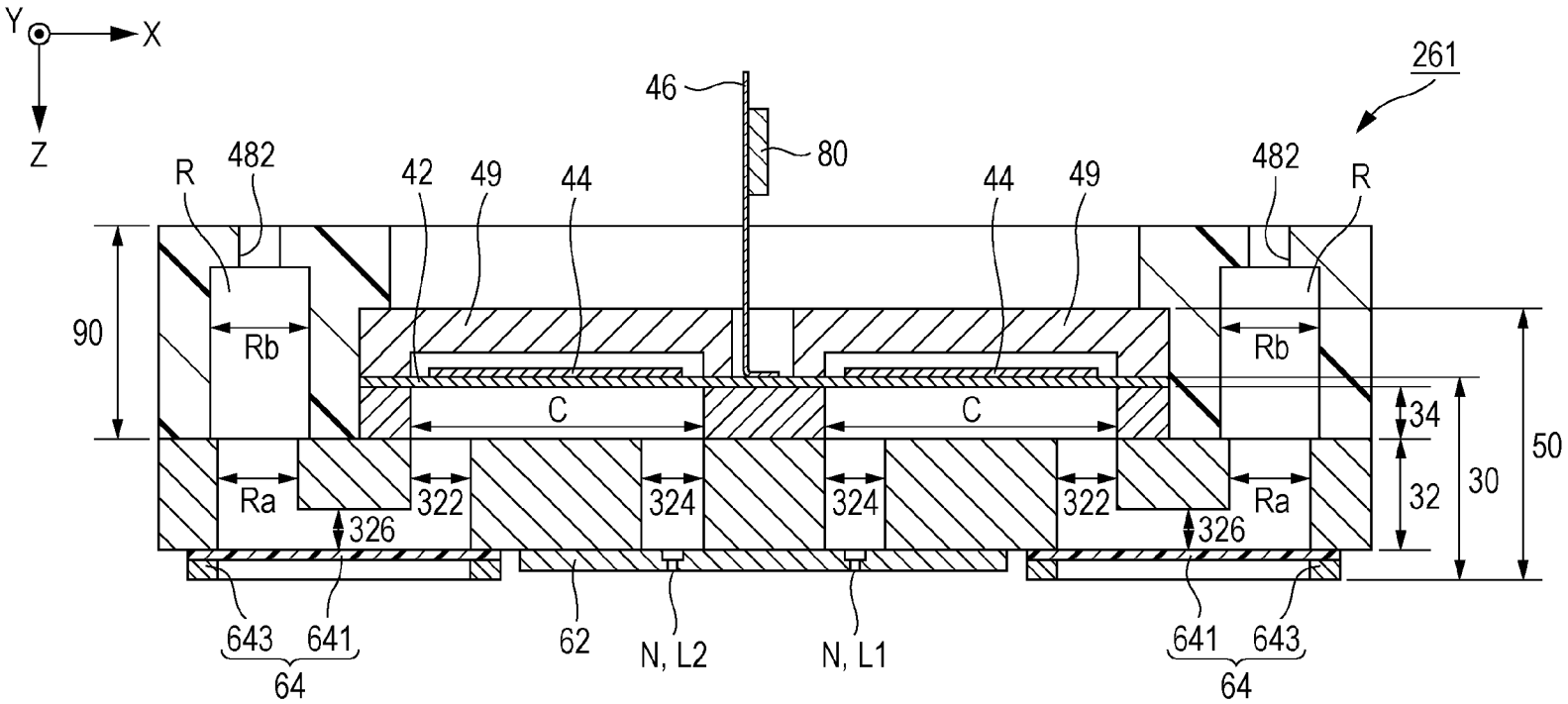
FIG. 6 is a cross-sectional view of a head unit according to a modification.

(7) In the configurations described above, a configuration is adopted in which each drive circuit 80 is mounted on the surface of the wiring substrate 46 on the side opposite the flow path structure 30; however, the position at which each drive circuit 80 is mounted is not limited to the example described above. For example, as illustrated in FIG. 6, a configuration in which the drive circuit 80 is mounted on a flexible wiring substrate 46 whose end portion is joined to the flow path structure 30 is also adopted. In the above configuration, the piezoelectric elements 44 are each covered by a sealing portion 49. However, compared with the configuration illustrated in FIG. 6, in the example configurations of the embodiments described above, the heat generated by the drive circuits 80 tends to be accumulated inside the head units 261. Accordingly, a configuration in which the support 265 in contact with the fixing plate 263 is formed of a material having a thermal conductivity higher than that of the containing body 90 of each head unit 261 is more effective.

(8) The driving elements that eject the ink in the pressure chambers C through the nozzles N are not limited to the piezoelectric elements 44 exemplified in the embodiments described above. For example, heating elements that generate air bubbles inside the pressure chambers C through heating to change the pressure therein may be used as the driving elements. As it can be understood from the examples described above, the driving elements are expressed comprehensively as elements that eject the liquid in the pressure chambers C through the nozzles N, and the operation system (piezoelectric system/thermal system) and the specific configuration of the driving elements do not matter.

(9) In the configurations described above, the liquid ejecting apparatus 100 of a serial type in which the transport body 242 on which the head units 261 are mounted is reciprocated is described as an example; however, the present disclosure can be applied to a liquid ejecting apparatus of a line type in which a plurality of nozzles N are distributed across an entire width of a medium 12. In the line-type liquid ejecting apparatus, the liquid ejecting head is a line head and includes a casing in contact with the support and to which the liquid ejecting head is fixed. With the above configuration, since the support 265 is in contact with the casing to which the liquid ejecting head is fixed, there is an advantage that the heat of the head unit can be released through the casing.

(10) The liquid ejecting apparatuses 100 described as examples in each of the configurations described above may be employed in various apparatuses other than an apparatus dedicated to printing, such as a facsimile machine and a copier. Note that the application of the liquid ejecting apparatus of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting head comprising:

a head unit including, a liquid ejecting unit that ejects a liquid from a nozzle, a drive circuit that drives the liquid ejecting unit, and a containing body in which a space that stores the liquid is formed;

a fixing plate which contacts the head unit on a nozzle side of the head unit; and a support that contacts the fixing plate and that supports the head unit, wherein the support is formed of a material having a thermal conductivity higher than that of the containing body, the support includes a first sidewall portion and a second sidewall portion that contact the outer periphery of the fixing plate, the head unit is positioned between the first sidewall portion and the second sidewall portion, and the support includes a contact portion that contacts the fixing plate at a portion between the first sidewall portion and the second sidewall portion.

2. The liquid ejecting head according to claim 1, wherein the support is formed of metal.

3. The liquid ejecting head according to claim 1, wherein the liquid ejecting unit includes, a flow path structure that contacts the fixing plate, the flow path structure having a pressure chamber in communication with the nozzle formed therein, a driving element positioned on the flow path structure on a side of the flow path structure opposite the nozzle, the driving element changing a pressure in the pressure chamber, and a wiring substrate positioned on a side opposite the flow path structure with respect to the driving element, wiring that electrically connects the drive circuit and the driving element to each other being formed in the wiring substrate, wherein the drive circuit is mounted on a surface of the wiring substrate on a side opposite the flow path structure.

4. The liquid ejecting head according to claim 1, wherein the support has a thermal conductivity that is higher than that of the fixing plate.

5. The liquid ejecting head according to claim 1, wherein the support is formed of a material having aluminum.

6. The liquid ejecting head according to claim 1, wherein the support has recesses or projections on the surface.

7. The liquid ejecting head according to claim 1, wherein the fixing plate is formed of a material having a thermal conductivity higher than that of the containing body.

8. The liquid ejecting head according to claim 1, wherein the drive circuit is at an opening in the containing body.

9. The liquid ejecting head according to claim 1, wherein the support has a channel through which liquid flows.

10. A liquid ejecting head comprising:

a head unit including, a liquid ejecting unit that ejects a liquid from a nozzle, a drive circuit that drives the liquid ejecting unit, and a containing body in which a space that stores the liquid is formed;

a fixing plate which contacts the head unit on a nozzle side of the head unit;

a support that contacts the fixing plate and that supports the head unit, wherein the support is formed of a material having a thermal conductivity higher than that of the containing body; and a plurality of the head units including a first head unit and a second head unit, wherein the support includes a contact portion that contacts the fixing plate at a portion between the first head unit and the second head unit.

11. The liquid ejecting head according to claim 10, wherein at least one of the first head unit and the second head unit ejects a black liquid.

12. The liquid ejecting head according to claim 10, wherein the support is formed of metal.

13. The liquid ejecting head according to claim 10, wherein the liquid ejecting unit includes, a flow path structure that contacts the fixing plate, the flow path structure having a pressure chamber in communication with the nozzle formed therein, a driving element positioned on the flow path structure on a side of the flow path structure opposite the nozzle, the driving element changing a pressure in the pressure chamber, and a wiring substrate positioned on a side opposite the flow path structure with respect to the driving element, wiring that electrically connects the drive circuit and the driving element to each other being formed in the wiring substrate, wherein the drive circuit is mounted on a surface of the wiring substrate on a side opposite the flow path structure.

14. The liquid ejecting head according to claim 10, wherein the support has a thermal conductivity that is higher than that of the fixing plate.

15. The liquid ejecting head according to claim 10, wherein the support is formed of a material having aluminum.

16. The liquid ejecting head according to claim 10, wherein the support has recesses or projections on the surface.

17. The liquid ejecting head according to claim 10, wherein the fixing plate is formed of a material having a thermal conductivity higher than that of the containing body.

18. The liquid ejecting head according to claim 10, wherein the drive circuit is at an opening between the containing body.

19. The liquid ejecting head according to claim 10, wherein the support has a channel through which liquid flows.

* * * * *